US005651223A

United States Patent [19]

Novak et al.

[11] Patent Number: 5,651,223

[45] Date of Patent: Jul. 29, 1997

[54] DOOR FRAME

[75] Inventors: William S. Novak, Monroeville; William C. Paul, Gibsonia; Gregory P. Irving, Cheswick; Edward Kridler, Gibsonia, all of Pa.

[73] Assignee: Chelsea Building Products, Oakmont, Pa.

[21] Appl. No.: 522,029

[22] Filed: Aug. 31, 1995

[51] Int. Cl.[6] ..... E06B 1/04

[52] U.S. Cl. ..... 52/211; 52/213; 52/204.1; 52/656.4; 49/504; 49/399

[58] Field of Search ..... 52/204.1, 211, 52/213, 207, 210, 656.9, 656.3, 656.6, 656.4, 731.5; 49/399, 478, 504

[56] References Cited

U.S. PATENT DOCUMENTS

| | | | |
|---|---|---|---|
| 1,054,575 | 2/1913 | Levene | 52/731.5 |
| 3,591,985 | 7/1971 | Coppins | 49/504 |
| 3,812,621 | 5/1974 | Ragland | 52/210 X |
| 4,015,382 | 4/1977 | Noyes | 52/211 |
| 4,573,287 | 3/1986 | Hagemeyer et al. | 49/504 X |
| 4,974,366 | 12/1990 | Tizzoni | 49/399 X |
| 5,293,723 | 3/1994 | Slessor | 52/204.1 X |
| 5,456,054 | 10/1995 | Coupet | 52/656.4 X |

FOREIGN PATENT DOCUMENTS

| | | | |
|---|---|---|---|
| 0633383 | 1/1995 | European Pat. Off. | 52/204.1 |
| 2501771 | 9/1982 | France | 52/204.1 |
| 2276187 | 9/1994 | United Kingdom | 52/204.1 |

OTHER PUBLICATIONS

General Electric Geloy Data Sheet.
General Electric Product Data Sheet.
General Electric Product Data Sheet Cycolac, pp. 4–5 and 10 and Geloy, pp. 20–21.
"ABS — An Alternative Raw Material for Window Profiles" by Walter Ganzberger, 1994.
"How ABS Windows May Challenge PVC" by Joseph Ogando, Plastics Technology, Jun., 1994.
"Engineered Thermoplastics Offer Unique SOlutions for Window and Door Industry" by Bob Nelson, Fenestration, Sep./Oct. 1995.
"Weatherable Technologies Expand Windows' Reach" by Robert D. Leaversuch, Modern Plastics, Mar., 1995.

*Primary Examiner*—Carl D. Friedman
*Assistant Examiner*—Winnie Yip
*Attorney, Agent, or Firm*—Buchanan Ingersoll, P.C.

[57] ABSTRACT

A door frame made of synthetic material having an elongated, horizontally-oriented head and an elongated, horizontally-oriented sill, spaced apart from the head portion. The head and sill are preferably single, continuous members. The door frame also has at least two spaced apart, vertically-oriented jambs, each connected at one end to the head and at an opposite end to the sill. The jambs have a cavity disposed vertically therethrough. A rigid supporting member is then provided within selected jamb cavities. The rigid supporting members are preferably made of metal, such as aluminum, aluminum alloys and ferrous and non-ferrous materials. The jambs may further have more than one cavity disposed vertically therethrough, so that more than one supporting member is provided in a jamb.

14 Claims, 5 Drawing Sheets

DOOR FRAME

BACKGROUND OF THE INVENTION

1. Field of the Invention

The present invention relates to entry door frames and more particularly to entry door frames having reinforcement members provided therein.

2. Description of the Prior Art

Door frames have been utilized in the building products industry for a long time. For many years door frames were virtually always constructed of wood. Although wood was a generally acceptable material for such products, the use of wood resulted in several disadvantages. Wood is subject to impact damage, i.e., denting and splintering upon contact. Further, over time wood may shrink, swell, bow, warp, crack or rot. Deterioration of wood commonly resulted from contact with moist, salt laden air as well as from contact with pollution and air borne chemicals. And although structurally rigid, wood is relatively heavy as compared to other materials. Moreover, in order to appear aesthetically appealing, wood must typically be painted and/or stained initially and then repainted periodically. The paint itself can fade, streak, flake or peel, resulting in an unattractive appearance.

More recently, synthetic materials have been utilized in connection with door frames. Polyvinyl chloride ("PVC") has been the most commonly utilized synthetic material. In general, synthetic materials have shown superior qualities of wood when utilized in door frames. For example, PVC has very favorable long term weatherability and UV performance. PVC can be extruded to have a finished appearance, thus requiring no painting and/or finishing. Also, PVC is waterproof and is therefore resistant to water damage and to damage resulting from moist, salt laden air, pollution and air borne chemicals. Further, PVC is generally resistant to impact damage and can withstand mechanical stress and strain. PVC is also impervious to insects. However, PVC displays limited heat resistance and, therefore, has limited applicability in areas having very hot climates.

Even more recently, other synthetic materials have been utilized in the building construction industry for window and door profiles. In particular, acrylonitrile butadiene styrene ("ABS") has been utilized by itself or with a co-extruded surface protection coating of acrylate styrene acrylonitrile ("ASA"). The ABS/ASA combination displays many of the beneficial features that are shown by PVC. Further, the ABS/ASA combination has higher impact resistance and reduced weight per volume than PVC. However, as with all synthetic materials, the ABS/ASA combination is susceptible to heat damage.

Safety is a primary consideration in the home building products industry. For example, homes having an integral garage are required by many local ordinances to have an internal metal door separating the garage from the remainder of the home. The function of the metal door is to assist in preventing fire from traveling from the garage into the home. Due to synthetic building materials being susceptible to fire damage, door frames for entry doors that are made of synthetic material have been known to melt during fires. When the door frame melts, the door falls away from the home leaving an opening for air currents to enter the home, fueling the fire.

Despite the superiority of synthetic material over wood in many areas, many purchasers of home building products elect not to use synthetic materials in door frames. One reason why synthetic material door frames are bypassed is a perception by the consumer that the door frame constructed of synthetic material is not sufficiently substantial (i.e., sturdy, strong, etc.). The ABS/ASA combination is particularly prone to this criticism due to its having a lower weight per volume than PVC. One solution is to provide the door frame with a solid door profile. This results in the use of much more synthetic material than is necessary, thus raising costs.

Therefore, it would be advantageous to develop an improved door frame design which utilizes synthetic materials. Such a door frame design should result in increased structural rigidity, a feeling of substantiality and an increased barrier to the spread of flames through the door frame. Such a door frame design should use a minimum amount of synthetic material in order to minimize material costs.

Furthermore, door frames in the prior art have typically utilized heads and sills that are fabricated from a number of different members. Typically, sections of the head and sill are joined together, end to end, in series. The jambs and mullions are then attached to sections of the head and sections of the sill. Thus, door frame structures have typically been fabricated in the industry from a number of individual pieces which are nailed, screwed or otherwise joined together. It would further be advantageous, therefore, to develop an improved door frame design which utilizes heads and sills which are fabricated of single, continuous members rather than a number of individual members joined together in series.

SUMMARY OF THE INVENTION

An improved door frame is provided for retaining a door that is movable through opened and closed positions relative to the door frame. The door frame is of the general type that is made of synthetic material. The door frame has an elongated, horizontally-oriented head portion. The head portion is preferably fabricated of a single, continuous member, rather than a number of members joined together in series. The door frame further has an elongated, horizontally-oriented sill portion that is spaced apart from the head portion. The sill portion is also preferably fabricated of a single, continuous member, rather than a number of members joined together in series.

The door frame also has at least two spaced apart, vertically-oriented jambs. Each of the jambs is connected at one end to the head portion and is connected at an opposite end to the sill portion. The door is pivotally connected, preferably by hinges, to one of the jambs as is well known in the industry. In this way, the outer periphery of the door is surrounded by the head portion, the sill portion and the jambs when the door is in the closed position.

One or more of the jambs, and preferably all of them, have a cavity disposed vertically therethrough. A rigid supporting member is then provided within selected ones of the jamb cavities. The rigid supporting members are preferably made of metal, such as aluminum, aluminum alloys and ferrous and nonferrous materials.

It is preferred that the rigid supporting members have a length substantially equal to the length of the jambs, so as to extend substantially the entire length of the jambs. The rigid supporting members also preferably have a width that is substantially parallel to the plane in which the door lies when the door is in the closed position. The jambs may further have more than one cavity disposed vertically therethrough, so that more than one supporting member is provided in a jamb.

The door frame may also have one or more vertically-extending pockets provided proximate to the jamb cavities. Thus, the vertical pockets extend parallel to the jamb cavities. An intumescent material may be provided within the pockets. Thus, in the event that the door frame is exposed to fire, the intumescent material will expand adjacent to the rigid supporting member, providing a barrier to fire.

The door frame of the present invention may be utilized in a simple door frame assembly having only the head, sill and two jambs on either side of the door. Alternatively, other door frame assemblies may be chosen which utilize the features of the present invention but which have more than two elongated, vertically-oriented jambs, in which each jamb is connected at one end to the head and is connected at an opposite end to the sill. Each of the jambs may have a vertical cavity disposed therethrough for retaining a respective rigid supporting member therein.

One such door frame design involves having two sets of vertically-oriented jambs being provided on each side of the door. A panel referred to in the industry as a side lite is then disposed between the pair of jambs in each set of jambs. Thus, spaced apart from one another and running substantially from the head to the sill are a first jamb, a first side lite, a second jamb, a door, a third jamb, a second side lite and a fourth jamb. This configuration is commonly referred to in the industry as a single door with two side lites.

Another door frame design also involves two sets of vertically-oriented jambs, but utilizes two doors. Thus, spaced apart from one another and running substantially from the head to the sill are a first jamb, a first side lite, a second jamb, a first door, a separator between the doors that is commonly referred to in the industry as an astragal, a second door, a third jamb, a second side lite and a fourth jamb. This configuration is commonly referred to in the industry as a double door with two side lites.

Selected ones of the jambs for any of the door frame designs may be constructed of more than one jamb member. For example, jambs which are positioned between a door panel and a side lite are preferably constructed of two jamb members that are connected to one another. Those jambs which are bordered at only one side by a side lite or door panel are preferably constructed of a single jamb member. Each jamb member preferably has a vertical cavity disposed therethrough for retaining a rigid supporting member therein. Thus, the jambs constructed of two jamb members (called a mullion) will preferably have two rigid supporting members therein.

Other objects and advantages of the invention will become apparent from a description of certain present preferred embodiments thereof shown in the drawings.

DETAILED DESCRIPTION OF THE PREFERRED EMBODIMENTS

An improved door frame is shown and described herein. Several embodiments of the door jamb are described herein in which various numbers of jambs are incorporated in the door frame configurations. For these various embodiments, the door jambs are either constructed of a single jamb member or two jamb members attached to one another. The jamb members in each case are preferably made of synthetic material and in particular are constructed of acrylonitrile butadiene styrene ("ABS") with a coextruded surface protection coating of acrylate styrene acrylonitrile ("ASA"). Use of synthetic materials such as polyvinyl chloride and, as is preferred, ABS/ASA, enables the jamb members to have relatively thin walls and allows for cavities and pockets to be provided therethrough, as will be more fully described herein.

Figure 1:
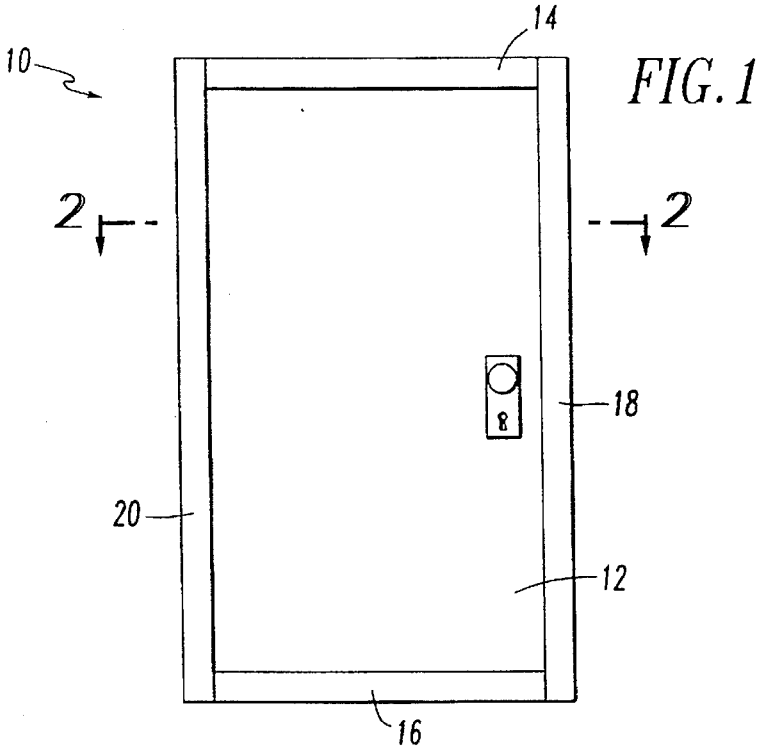
FIG. 1 is a front elevational view of a first preferred door frame construction in the closed position having a head, a sill, two jambs and a door.
Figure 2:
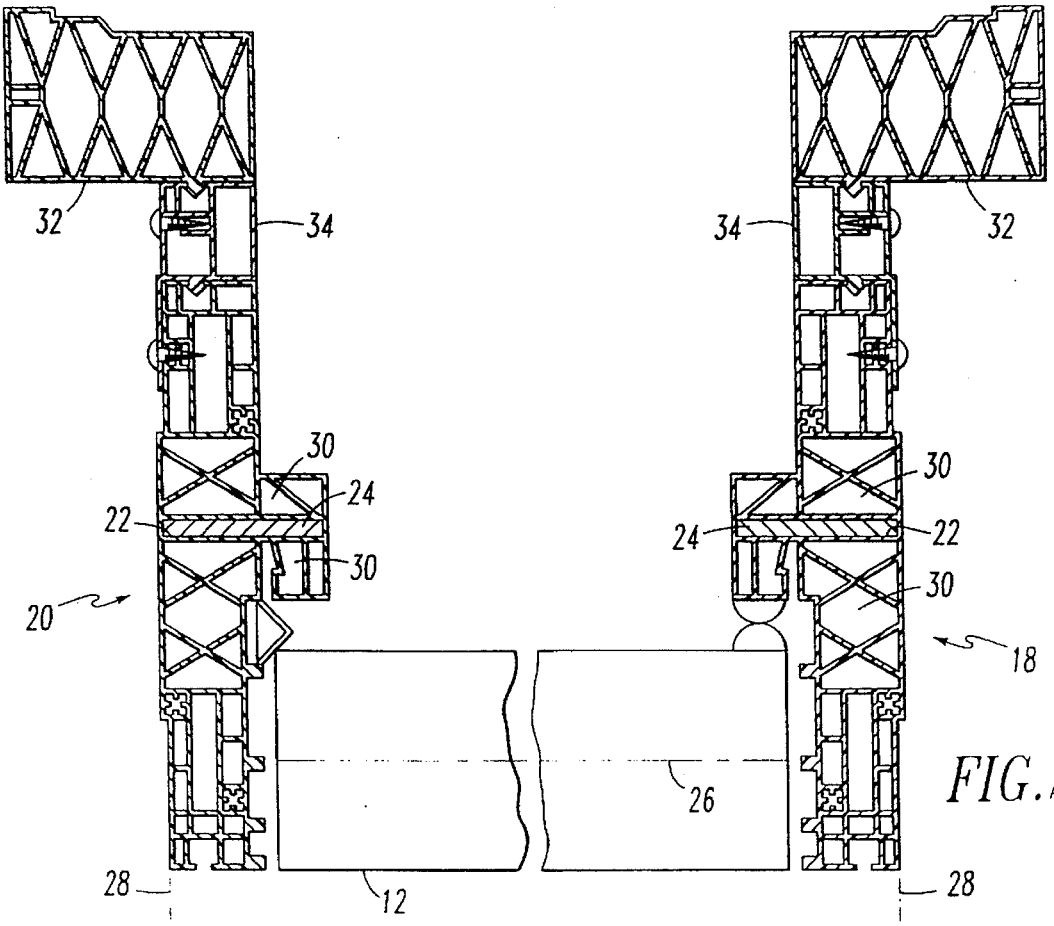
FIG. 2 is a cross sectional view taken along line 2—2 of FIG. 1.

Referring first to FIGS. 1 and 2, a first preferred door frame configuration 10 is shown in which a door 12 is retained within and is movable relative to the door frame. The door frame is comprised of an elongated, horizontally oriented head 14 and an elongated, horizontally oriented sill 16 that is spaced apart from the head 14. The door frame also includes two spaced apart, vertically oriented jambs 18, 20. As can be seen best in FIG. 1, jambs 18, 20 are each connected at one end to the head 14 and are connected at an opposite end to the sill 16. When the door 12 is in the closed position relative to the door frame as shown in FIG. 1, the periphery of the door 12 is surrounded by the head 14, the sill 16 and the jambs 18, 20.

Figure 7:
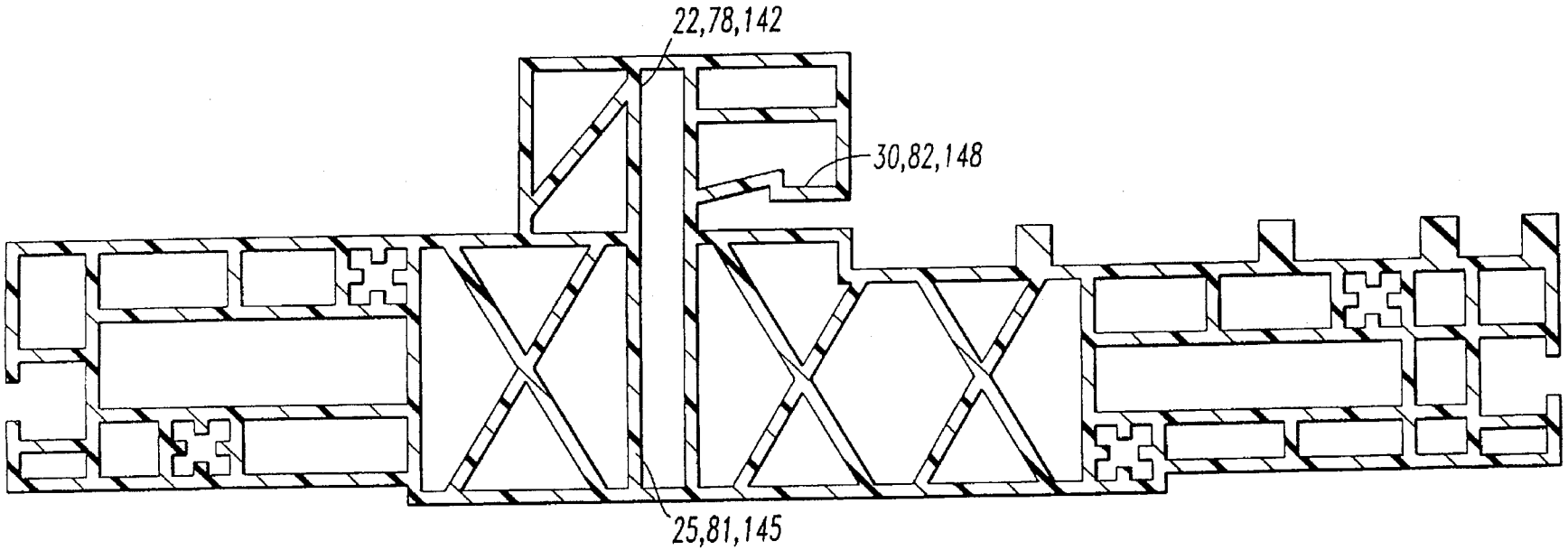
FIG. 7 is a view taken in cross section of a jamb member for use in the preferred door frame configurations.

As can be seen best in FIG. 2, the jambs 18, 20 of the first preferred door frame construction 10 are each constructed of a single jamb member. The preferred jamb member used in all the embodiments described herein is shown in FIG. 7.

Each of the jambs 18, 20 have an elongated cavity 22 disposed vertically therethrough. Within each cavity 22 is preferably provided a rigid supporting member 24 (for clarity, the rigid supporting member 24 is shown only in cavity 22 of jamb 20). Although not shown, the head 14 may also have a cavity disposed therethrough having a rigid supporting member provided therein.

It is preferred that the vertical cavities 22 through jambs 18, 20 extend substantially the full length of the jambs 18, 20. It is further preferred that the rigid supporting members 24 also have a length substantially equal to the length of the jambs 18, 20, so as to extend the entire length of the jambs 18, 20.

The door frame 10 is positioned within a wall of a home, thus, the jambs 18, 20 are placed adjacent the walls of the house in which the door frame is installed. The position of the walls of the home in which the door frame is installed is depicted by dotted lines 28. It is preferred that the rigid supporting members 24 have a width which extends substantially from the location of the walls 28 of the home in which the door frame is installed to a point past the nearest end of the door 12, which width is approximately 1.20 inches. It is further preferred that the rigid supporting members 24 be relatively thin in breadth so as to reduce the weight of the door frame and to reduce fabrication costs. The preferred breadth dimension of the rigid supporting members 24 is 0.112 inches.

The door 12 has a transverse axis depicted as dotted line 26 in FIG. 2 which extends along the width of the door 12. As can be seen best in FIG. 2, the rigid supporting members 24 preferably have a width that is substantially parallel to the transverse axis 26 of the door 12 when the door 12 is in the closed position. The rigid supporting members 24 are preferably made of metal, such as aluminum, aluminum alloys and other ferrous and non-ferrous materials.

Although only one vertically extending cavity 22 for accepting a rigid supporting member is shown for each jamb 18, 20, it is understood that more than one elongated cavity 22 may be provided within each jamb 18, 20 so as to enable each jamb 18, 20 to receive more than one rigid supporting member. Similarly, each elongated cavity 22 need not contain a rigid supporting member 24.

The door frame 10 may also have one or more vertically extending pockets 30 provided proximate to each elongated jamb cavity 22. It is preferred that the pockets 30 extend substantially the entire length of the jambs 18, 20 and are thus parallel to each jamb cavity 22. The pockets 30 are preferably disposed between the jamb cavity 22 and the plane of the door when the door is in the closed position. It is also preferred that the internal walls 25 bordering and defining the pockets 30 and jamb cavities 22 be relatively thin, having a thickness of from approximately 0.025 inches to 0.035 inches. However, it is understood that any dimensions may be utilized for the internal walls.

An intumescent material (not shown) may then be provided within the pockets 30. The intumescent material is of the type that expands when exposed to fire. Thus, in the event that the door frame is exposed to fire, intumescent material will expand adjacent to the rigid supporting member 24. It is further preferred that the intumescent material be provided in pockets 30 that are positioned between the rigid supporting members 24 and the door 12. In this way, the expanded intumescent material and the rigid supporting members 24 together with the door 12 will form a barrier to the fire between the walls 28 of the home in which the door frame 10 is installed.

Brickmolds 32 are preferably connected to the jambs 18, 20. Jamb extensions 34 may be utilized if desired so as to be provided between the brickmolds 32 and the jambs 18, 20.

Figure 3:
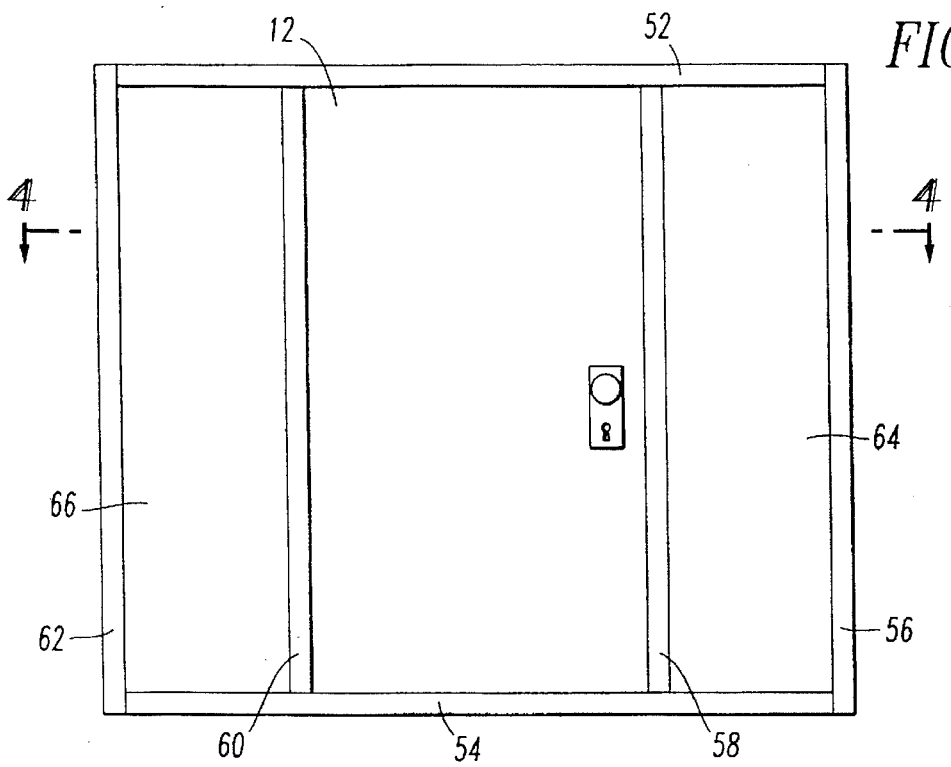
FIG. 3 is a front elevational view of a second preferred door frame construction in the closed position having a head, a sill, two side lites, four jambs and a door.
Figure 4:
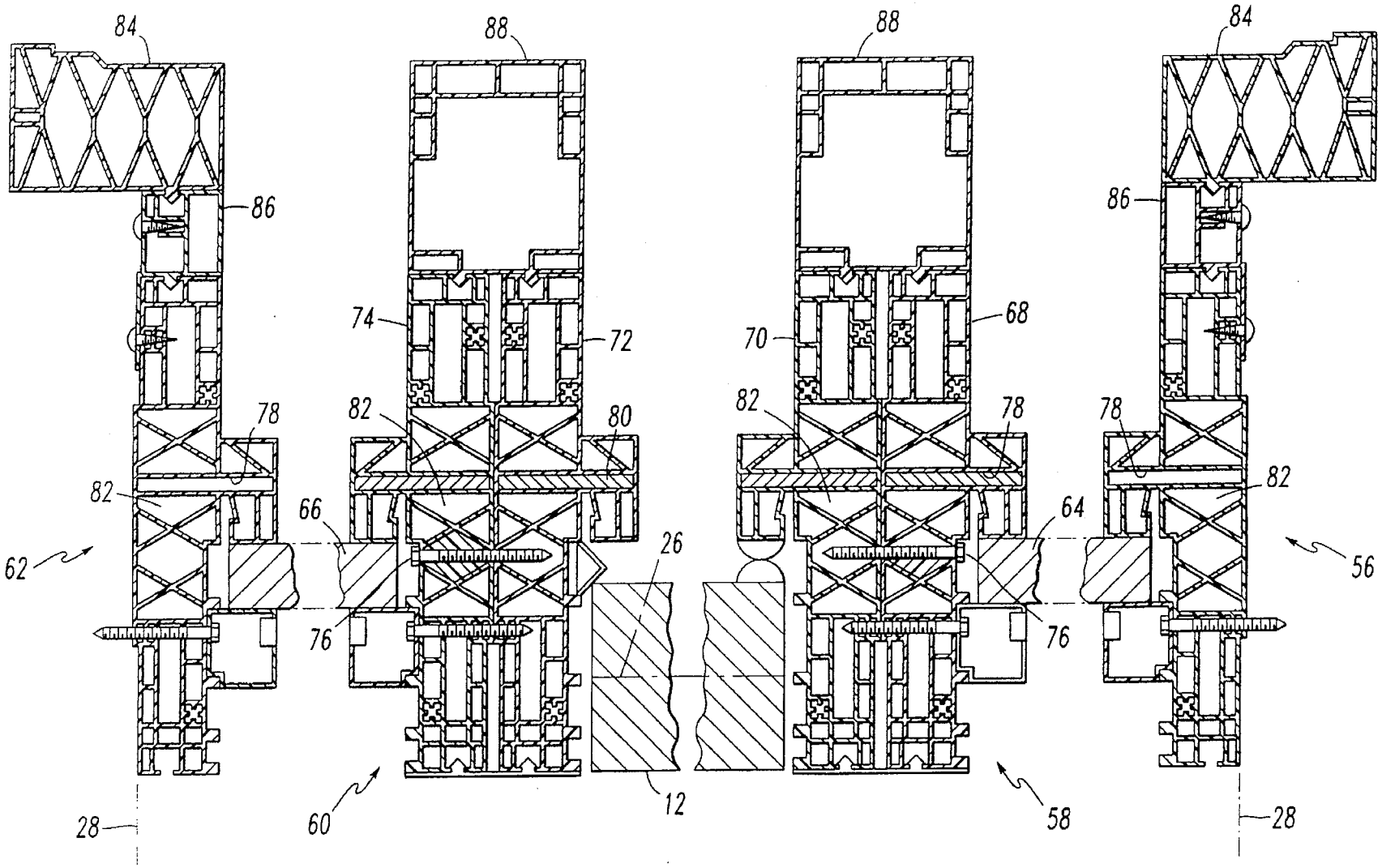
FIG. 4 is a cross sectional view taken along line 4—4 of FIG. 3.

Referring next to FIGS. 3 and 4, a second preferred door frame configuration 50 is shown. As with the first preferred door frame configuration 10, a door 12 is retained within and is movable relative to the door frame. The door frame is comprised of an elongated, horizontally oriented head 52 and an elongated, horizontally oriented sill 54 that is spaced apart from the head 52.

The door frame also includes four spaced apart, vertically oriented jambs 56, 58, 60, 62. As can be seen best in FIG. 3, jambs 56, 58, 60, 62 are each connected at one end to the head 52 and are connected at an opposite end to the sill 54. When the door 12 is in the closed position relative to the door frame as shown in FIG. 3, the periphery of the door 12 is surrounded by head 52, the sill 54 and jambs 58, 60.

Two side lites 64, 66 are also incorporated in the door frame structure 50 with one side lite being provided on each side of the door 12 when the door 12 is in the closed position as shown in FIG. 3. Thus, side lite 64 is surrounded by head 52, sill 54 and jambs 56, 58. Similarly, side lite 66 is surrounded by head 52, sill 54 and jambs 60, 62. Although jambs 58, 60 that are positioned between a door and a side lite (i.e., are not secured to the structural wall of a home in which the door frame is secured) are frequently referred to as "mullions" in the entry door industry, the term jamb will be used herein to include mullions. It is preferred that the head 52 and sill 54 are each fabricated of a single, continuous member.

Referring particularly to FIG. 4, it is preferred that jamb 56 and jamb 62 are each constructed of a single jamb member. However, jamb 58 is preferably constructed of two jamb members 68, 70 that are affixed to one another. Similarly, it is preferred that jamb 60 be constructed of two jamb members 72, 74 that are affixed to one another. The jamb members of jambs 58, 60 may be affixed to one another by any convenient means such as by screws 76.

As can be seen best in FIG. 4, each of the jambs 56, 58, 60, 62 of the second preferred door frame structure 50 has an elongated cavity 78 disposed vertically therethrough. Within each cavity 78 is preferably provided a rigid supporting member 80 (for clarity, rigid supporting members 80 are shown only in jamb 60). As can be seen in FIG. 4, the jamb members 68, 70 of jamb 58 and the jamb members 72, 74 of jamb 60 may each have its own vertically extending cavity 78 disposed therethrough. Thus, jambs 58, 60 have two vertical cavities 78 disposed therethrough for receiving rigid supporting members 80, while jambs 56, 62, which have a single jamb member, have a single cavity 78 extending vertically therethrough for receiving a rigid supporting member 80.

It is preferred that the vertical cavities 78 through jambs 56, 58, 60, 62 extend substantially the full length of the jambs 56, 58, 60, 62. It is further preferred that the rigid supporting members 80 also have a length substantially equal to the length of the jambs 56, 58, 60, 62, so as to extend the entire length of the jambs 56, 58, 60, 62.

As can be seen best in FIG. 4, the rigid supporting members 80 preferably have a width that is substantially parallel to the transverse axis 26 extending along the width of the door 12 when the door 12 is in the closed position. As with the preceding embodiment, the rigid supporting members 80 are preferably made of metal, such as aluminum, aluminum alloys or other suitable ferrous and non-ferrous materials.

As with the preceding embodiment, the door frame 50 is positioned within the wall of a home, thus, jambs 56, 62 are placed adjacent to the walls 28 (shown in dotted line in FIG. 4) of the house in which the door frame S0 is installed. It is preferred that the rigid supporting member 80 which is provided within jamb 56 have a width which extends substantially from the location of the wall 28 of the home in which the door frame 50 is installed to a point past the nearest end of side lite 64, which width is approximately 1.20 inches. Similarly, the rigid supporting member 80 provided in jamb 62 preferably has a width which extends substantially from the location of the wall 28 of the home in which the door frame is installed to a point past the nearest end of side lite 66, which width is approximately 1.20 inches.

Jambs 58, 60 are each preferably comprised of two jamb members affixed together. It is preferred that the elongated cavities 78 of jamb members 68, 70 be aligned so as to extend in series substantially parallel to the longitudinal axis 26 of the door 12 when the door 12 is in the closed position. Similarly, the cavities 78 of jamb members 72, 74 are also similarly aligned so that the rigid supporting members 80 provided within jamb members 72, 74 of jamb 60 be substantially parallel to longitudinal axis 26 of the door 12 when the door 12 is in the closed position. Thus, the rigid supporting members provided in jamb 58 preferably extend from a point past the nearest end of side lite 64 to a point past the nearest end of door 12. Similarly, the rigid supporting members 80 provided in jamb 60 also preferably extend from a point past the nearest end of side lite 66 to a point past the nearest end of the door 12. It is further preferred that the rigid supporting members 80 be relatively thin in breadth so as to reduce the weight of the door frame and to reduce fabrication costs. The preferred breadth dimension of the rigid supporting members 80 is approximately 0.112 inches.

The door frame 50 may also have one or more vertically extending pockets 82 provided proximate to each elongated jamb cavity 78. As described with reference to the first preferred door frame 10, the pockets 82 preferably extend substantially the entire length of the jambs 56, 58, 60, 62 parallel to each jamb cavity 78 and between the jamb cavity 78 and the plane of the door when the door is in the closed position. It is also preferred that the internal walls 81 (see FIG. 7) bordering and defining the pockets and jamb cavities be relatively thin, having a thickness of from approximately 0.025 inches to 0.035 inches. However, any thickness of the internal walls may be utilized.

An intumescent material may then be provided within the pockets 82. In this way, in the event of a fire the expanded intumescent material, the rigid supporting members, the side lites and the door will form a barrier to the fire between the walls 28 of the home in which the door frame 50 is installed.

Brickmolds 84 are preferably connected to the jambs 56, 62. Jamb extensions 86 may be utilized if desired so as to be provided between the brickmolds 84 and the jambs 56, 62. Extensions 88 may also be provided along the jambs 58, 60 (i.e., the mullions).

Figure 5:
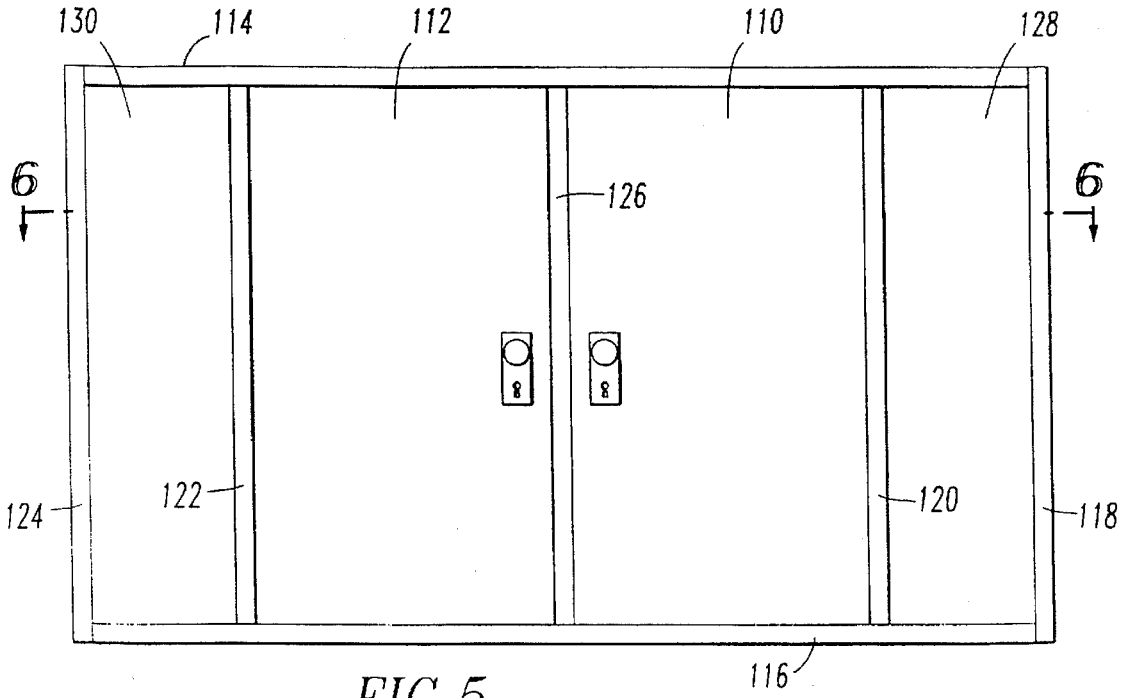
FIG. 5 is a front elevational view of a third preferred door frame construction in the closed position having a head, a sill, two side lites, four jambs, two doors and an astragal.
Figure 6:
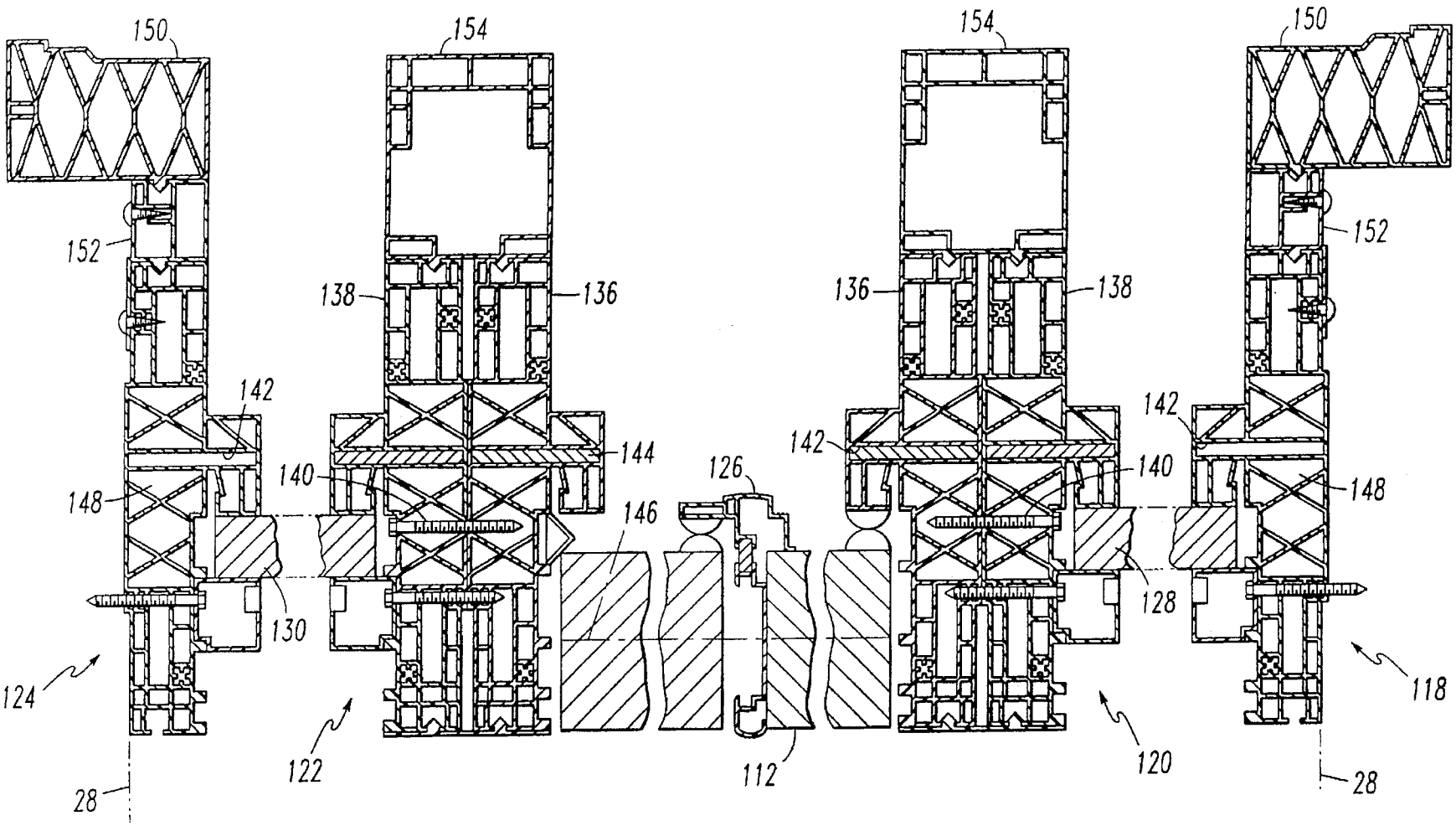
FIG. 6 is a cross sectional view taken along line 6—6 of FIG. 5.

Referring next to FIGS. 5 and 6, a third preferred door frame configuration 100 is shown. In this door frame configuration, two doors 110, 112 are retained within and are movable relative to the door frame. The door frame is comprised of an elongated, horizontally oriented head 114 and an elongated, horizontally oriented sill 116 that is spaced apart from the head 114.

The door frame also includes four spaced apart, vertically oriented jambs 118, 120, 122, 124. As can be seen best in FIG. 5, jambs 118, 120, 122, 124 are each connected at one end to the head 114 and are connected at an opposite end to the sill 116. An elongated vertically extending member called an astragal 126 is provided between the two doors 110, 112. Thus, when the doors 110, 112 are in the closed position relative to the door frame as shown in FIG. 5, the periphery of the doors 110, 112 are surrounded by the head 114, the sill 116, jambs 120, 122 and astragal 126.

Two side lites 128, 130 are also incorporated in the door frame structure 100 with one side lite being provided on each side of the doors 110, 112 when the doors 110, 112 are in the closed position as shown in FIG. 5. Thus, side lite 128 is surrounded by head 114, sill 116 and jambs 118, 120. Similarly, side lite 130 is surrounded by head 114, sill 116 and jambs 122, 124. As with the preceding embodiments of the door frame, it is preferred that the head 114 and the sill 116 be fabricated of a single, continuous member.

As can be seen best in FIG. 6, it is preferred that jamb 118 and jamb 124 be constructed of a single jamb member. However, it is preferred that jamb 120 and jamb 122 each be constructed of two jamb members that are affixed to one another. Thus, jamb 120 is preferably constructed of two jamb members 132, 134 that are affixed together. Jamb members 132, 134 may be affixed together by any convenient means such as by screws 140. Similarly, jamb 122 is preferably constructed of two jamb members 136, 138 affixed to one another by any convenient means such as screws 140.

As can be seen best in FIG. 6, each of the jambs 118, 120, 122, 124 of the third preferred door frame structure 100 has an elongated cavity 142 disposed vertically therethrough. Within each cavity 142 is preferably provided a rigid supporting member 144. For clarity, rigid supporting members 144 are shown only inserted within the cavities 142 of jamb 122. As can also be seen in FIG. 6, the jamb members 132, 134 of jamb 120 and the jamb members 136, 138 of jamb 122 may each have its own vertically extending cavity 142 disposed therethrough. Thus, jambs 120, 122 have two vertical cavities 132 disposed therethrough for receiving rigid supporting members 144 therein, while jambs 118, 124, which are formed of a single jamb member have a single cavity 142 extending vertically therethrough for receiving a rigid supporting member 144.

As with the previous preferred embodiments, it is preferred that the vertical cavities 142 through the jambs 118, 120, 122, 124 extend substantially the full length of the jambs 118, 120, 122, 124 and that the rigid supporting members 144 also have a length substantially equal to the length of the jambs 118, 120, 122, 124.

Doors 110, 112 have a transverse axis 146 which extends along the width of the doors 110, 112 when the doors 110, 112 are in the closed position. The rigid supporting members 144 preferably have a width that is substantially parallel to the transverse axis 146 of doors 110, 112 when the doors are in a closed position. As with the preceding embodiments, the rigid supporting members 144 are preferably made of metal, such as aluminum, aluminum alloys and ferrous and non-ferrous materials, although any suitable material may be used.

The door frame 100, as with the preceding embodiments, is positioned within the walls 28 of a home. Thus, jambs 118, 124 are placed adjacent to the walls 28 (shown in dotted line in FIG. 6) of the house in which the door frame 100 is installed. It is preferred that the rigid supporting member 144 which is provided within jamb 118 have a width which extends substantially from the location of the wall 28 to a point past the nearest end of side lite 128, which width is approximately 1.20 inches. Similarly, the rigid supporting member 144 provided in jamb 124 preferably has a width which extends substantially from the location of the wall 28 to a point past the nearest end of side lite 130, which width is approximately 1.20 inches.

As can be seen in FIG. 6, jambs 120, 122 are each preferably comprised of two jamb members affixed together. It is preferred that the elongated cavities 142 of jamb members 132, 134 be aligned so as to extend in series substantially parallel to the longitudinal axis 146 of the doors 110, 112 when doors 110, 112 are in the closed position. Similarly, the cavities 142 of jamb members 136, 138 are also similarly aligned so that the rigid supporting members 144 provided within jamb members 136, 138 be substantially parallel to longitudinal axis 146 of the doors 110, 112 when the doors 110, 112 are in the closed position. Thus, the rigid supporting members provided in jamb 120 preferably extend from a point past the nearest end of side lite 128 to a point past the nearest end of door 110. Similarly, the rigid supporting members 144 provided in jamb 122 also preferably extend from a point past the nearest end of side lite 130 to a point past the nearest end of door 112. It is further preferred that the rigid supporting members 144 be relatively thin in breadth so as to reduce the weight of the door frame and to reduce fabrication costs. Thus, the preferred breadth dimension of the rigid supporting members 144 is approximately 0.112 inches.

As described with reference to the preceding preferred embodiments of the door frames 10, 50, door frame 100 may also have one or more vertically extending pockets 148 provided proximate to each elongated jamb cavity 142. The pockets 148 preferably extend substantially the entire length of the jambs 118, 120, 122, 124 parallel to each jamb cavity 142 and between the jamb cavity 142 and the plane of the door when the door is in the closed position. It is also preferred that the internal walls 145 (see FIG. 7) bordering and defining the pockets and jamb cavities be relatively thin, having a thickness of from approximately 0.025 inches to 0.035 inches. However, any preferred thickness of the internal walls may be utilized.

An intumescent material may then be provided within the pockets 148 so that in the event of fire, the expanded intumescent material prevent the door frame from melting and collapsing. Preferably the intumescent material is provided within pockets lying between the rigid supporting members 144 and side lites 128, 130 and doors 110, 112, respectively.

Brickmolds 150 are preferably connected to the jambs 118, 124. Jamb extensions 152 may be utilized if desired so as to be provided between the brickmolds 150 and the jambs 118, 124. Extensions 154 may also be provided along the jambs 120, 122 (i.e., the mullions).

While certain present preferred embodiments have been shown and described, it is distinctly understood that the invention is not limited thereto but may be otherwise embodied within the scope of the following claims.

We claim:

1. A door frame made of synthetic material for retaining a door movable through opened and closed positions, the door frame comprising:

an elongated, horizontally oriented head portion;

an elongated, horizontally oriented, sill portion spaced apart from said head portion;

more than two elongated, vertically-oriented jambs, wherein each said jamb has a selected length and is connected at one end to said head and is connected at an opposite end to said sill, and wherein each of said jambs has a vertical cavity disposed therethrough, and wherein each of said jambs further has at least one vertically extending pocket provided proximate to said jamb cavities and extending parallel to the jamb cavities substantially along the entire length of the jambs; and an elongated rigid supporting member provided within each jamb, wherein said rigid supporting members are disposed within respective jamb cavities, and wherein said rigid supporting members have a length substantially equal to the length of said jambs;

wherein at least two of said vertically-oriented, spaced-apart jambs are provided at a first position, and at least one of said vertically-oriented, spaced-apart jambs is provided at a second position spaced apart from the first position for locating the door therebetween, and wherein a side lite is disposed between two of the jambs provided on the first position; and wherein the door and the side lite lie generally in a common plane when the door is in the closed position and wherein the rigid supporting members provided in the jambs between the side lite and the door are oriented substantially parallel to the plane of the door and the side lite, in which such rigid supporting members overlap and support the side lite and the door.

2. The door frame of claim 1 wherein at least two of said vertically-oriented, spaced-apart jambs are provided on a second position on opposite side of the door from the first position, and wherein a side lite is disposed between two of the jambs provided on the second position.

3. The door flame of claim 1 wherein the head portion is a singly, unitary portion.

4. The door frame of claim 1 wherein the sill portion is a single, unitary portion.

5. A door frame made of synthetic material for retaining a door movable through opened and closed positions, the door frame comprising:

an elongated, horizontally oriented head portion;

an elongated, horizontally oriented, sill portion spaced apart from said head portion;

more than two elongated, vertically-oriented jambs, wherein each said jamb has a selected length and is connected at one end to said head and is connected at an opposite end to said sill, and wherein each of said jambs has a vertical cavity disposed therethrough, and wherein each of said jambs further has at least one vertically extending pocket provided proximate to said jamb cavities and extending parallel to the jamb cavities substantially along the entire length of the jambs;

an elongated rigid supporting member provided within each jamb, wherein said rigid supporting members are disposed within respective jamb cavities, and wherein said rigid supporting members have a length substantially equal to the length of said jambs;

wherein at least two of said vertically-oriented, spaced-apart jambs are provided at a first position, and wherein at least two of said vertically-oriented, spaced-apart jambs are provided on a second position spaced apart from the first position for locating the door therebetween and wherein a side lite is disposed between two of the jambs provided on the second position, and wherein the door and the side lite lie generally in a common plane when the door is in the closed position and wherein the rigid supporting members provided in the jambs between the side lite and the door are oriented substantially parallel to the plane of the door and the side lite, in which such rigid supporting members overlap and support the side lite and the door.

6. The door frame of claim 5 wherein the head portion is a single, unitary portion.

7. The door frame of claim 5 wherein the sill portion is a single, unitary portion.

8. A door frame made of synthetic material for retaining at least two doors movable through opened and closed positions, the door frame comprising:

an elongated, horizontally oriented head portion;

an elongated, horizontally oriented, sill portion spaced apart from said head portion;

more than two elongated, vertically-oriented jambs, wherein each said jamb has a selected length and is connected at one end to said head and is connected at an opposite end to said sill, and wherein each of said jambs has a vertical cavity disposed therethrough, and wherein each of said jambs further has at least one vertically extending pocket provided proximate to said jamb cavities and extending parallel to the jamb cavities substantially along the entire length of the jambs;

an elongated rigid supporting member provided within each jamb, wherein said rigid supporting members are disposed within respective jamb cavities, and wherein said rigid supporting members have a length substantially equal to the length of said jambs;

wherein at least two of said vertically-oriented, spaced-apart jambs are provided at a first position, and at least one of said vertically-oriented, spaced-apart jambs is provided at a second position spaced apart from the first position for locating the doors therebetween, and wherein a side lite is disposed between two of the jambs provided on the first position; and wherein the doors and the side lite lie generally in a common plane when the doors are in the closed position and wherein the rigid supporting members provided in the jambs between the side lite and the doors are oriented substantially parallel to the plane of the doors and the side lite, in which such rigid supporting members overlap and support the side lite and the doors.

9. The door frame of claim 8 wherein at least two of vertically-oriented, spaced-apart jambs are provided at the second position, on an opposite side of the doors from the jambs on the first position, and wherein a side lite is disposed between two of the jambs provided on the second position.

10. The door frame of claim 8 wherein the head portion is a single, unitary portion.

11. The door frame of claim 8 wherein the sill portion is a single, unitary portion.

12. A door frame made of synthetic material for retaining at least two doors movable through opened and closed positions, the door frame comprising:

an elongated, horizontally oriented head portion;

an elongated, horizontally oriented, sill portion spaced apart from said head portion:

more than two elongated, vertically-oriented jambs, wherein each said jamb has a selected length and is connected at one end to said head and is connected at an opposite end to said sill, and wherein each of said jambs has a vertical cavity disposed therethrough, and wherein each of said jambs further has at least one vertically extending pocket provided proximate to said jamb cavities and extending parallel to the jamb cavities substantially along the entire length of the jambs; and an elongated rigid supporting member provided within each jamb, wherein said rigid supporting members are disposed within respective jamb cavities, and wherein said rigid supporting members have a length substantially equal to the length of said jambs:

wherein at least two of said vertically-oriented, spaced-apart jambs are provided at a first position, and wherein a side lite is disposed between two of the jambs provided on the first position; and wherein at least two of said vertically-oriented, spaced-apart jambs are provided on a second position spaced apart from the first position for locating the doors therebetween, and wherein a side lite is disposed between two of the jambs provided on the second position, and wherein the doors and the side lite lie generally in a common plane when the doors are in the closed position and wherein the rigid supporting members provided in the jambs between the side lite and the doors are oriented substantially parallel to the plane of the doors and the side lite, in which such rigid supporting members overlap and support the side lite and the doors.

13. The door frame of claim 12 wherein the head portion is a single, unitary portion.

14. The door frame of claim 12 wherein the sill portion is a single, unitary portion.

* * * * *

UNITED STATES PATENT AND TRADEMARK OFFICE

CERTIFICATE OF CORRECTION

PATENT NO. : 5,651,223

DATED : July 29, 1997

INVENTOR(S) : WILLIAM S. NOVAK, WILLIAM C, PAUL, GREGORY P. IRVING, EDWARD KRIDLER

It is certified that error appears in the above-indentified patent and that said Letters Patent is hereby corrected as shown below:

Column 10, claim 3, line 3, change "flame" to —frame—.

Column 10, claim 3, line 4, change "singly" to —single—.

Signed and Sealed this

Sixteenth Day of December, 1997

*Attest:*

*Attesting Officer*

BRUCE LEHMAN

*Commissioner of Patents and Trademarks*